US005809371A

United States Patent [19]

Inui et al.

[11] Patent Number: 5,809,371

[45] Date of Patent: Sep. 15, 1998

[54] IMAGE FORMING APPARATUS DISPLAYING JOB END TIME

[75] Inventors: Kazuo Inui, Toyohashi; Hiroshi Yamada, Toyokawa; Junko Natsume, Hoi-Gun, all of Japan

[73] Assignee: Minolta Co., Ltd., Osaka, Japan

[21] Appl. No.: 942,646

[22] Filed: Oct. 2, 1997

[30] Foreign Application Priority Data

Mar. 7, 1997 [JP] Japan ..... 9-052936

[51] Int. Cl.[6] ..... G03G 15/00

[52] U.S. Cl. ..... 399/81; 399/9; 399/43; 399/82

[58] Field of Search ..... 399/9, 16, 18, 399/21, 38, 43, 81, 82, 85, 87

[56] References Cited

U.S. PATENT DOCUMENTS

| | | | |
|---|---|---|---|
| 4,511,243 | 4/1985 | Smith | 399/81 |
| 4,816,864 | 3/1989 | Tanaka et al. | 399/81 |
| 4,922,295 | 5/1990 | Takano et al. | 399/81 |
| 5,036,361 | 7/1991 | Filion et al. | 399/81 |
| 5,539,499 | 7/1996 | Fujisawa | 399/9 |
| 5,669,040 | 9/1997 | Hisatake | 399/82 X |
| 5,689,765 | 11/1997 | Nishinozono | 399/81 |

FOREIGN PATENT DOCUMENTS 7-076155 3/1995 Japan .

*Primary Examiner*—Sandra L. Brase
*Attorney, Agent, or Firm*—Sidley & Austin

[57] ABSTRACT

In a copying machine according to the invention, a plurality of jobs are read and registered, and printing and reading of thus registered jobs can be independently performed. In the copying machine, if printing is stopped during printing a job registered under number 4, for example and it is highly probable that the estimated ending time for printing of jobs under job numbers 4 and 5 will be changed, the estimated ending times for these jobs are displayed in dots unlike the normal display. As a result, the user can be informed that an estimated time for the end of printing for a certain job becomes inaccurate.

11 Claims, 10 Drawing Sheets

FIG. 10A

JOB CONFIRMATION | NEXT IMAGE | END

SETTINGS CONFIRMATION | CHANGE | DELETE

| No. | ORIGINAL | COPY | REGISTER | END | STATE | SOURCE |
|---|---|---|---|---|---|---|
| ① | 5 | 9 | 10 : 05 | 10 : 50 | COPY | COPY |
| ② | 1 | 5 | 10 : 09 | 10 : 55 | STAND BY | COPY |
| ③ | 9 | 10 | 10 : 12 | 11 : 00 | STAND BY | PERIPHERAL |
| ④ | 19 | 20 | 10 : 19 | 11 : 05 | STAND BY | COPY |
| ⑤ | 9 | 52 | 10 : 25 | 11 : 15 | READ | COPY |

REMAINING MEMORY CAPACITY: 10%

CURRENT TIME: 10 : 49

FIG. 10B

JOB CONFIRMATION | NEXT IMAGE | END

SETTINGS CONFIRMATION | CHANGE | DELETE

| No. | ORIGINAL | COPY | REGISTER | END | STATE | SOURCE |
|---|---|---|---|---|---|---|
| ① | 5 | 9 | 10 : 05 | 10 : 50 | COPY | COPY |
| ② | 1 | 5 | 10 : 09 | 10 : 55 | STAND BY | COPY |
| ③ | 9 | 10 | 10 : 12 | 11 : 00 | STAND BY | PERIPHERAL |
| ④ | 19 | 20 | 10 : 19 | | STAND BY | COPY |
| ⑤ | 9 | 52 | 10 : 25 | | READ | COPY |

REMAINING MEMORY CAPACITY: 10%

CURRENT TIME: 10 : 49

IMAGE FORMING APPARATUS DISPLAYING JOB END TIME

BACKGROUND OF THE INVENTION

1. Field of the Invention

The present invention relates generally to image forming apparatuses, and more particularly, to an image forming apparatus which stores prescribed read image data having consistency as a group of originals and forms images based on the stored image data.

2. Description of the Related Art

Among various image forming apparatuses such as copying machine and printer, there has been known an apparatus having a multi-job function which can read image data while printing an image, and can read image data from a group of originals independently from printing images of another group of originals.

Since such an image forming apparatus requires a longer time period for printing than for reading, some image forming apparatuses having such a multi-job function display a time period until image formation of a group of originals (hereinafter also referred to as "job") the user wishes to be formed into images is completed.

A printer disclosed by Japanese Patent Laying-Open No. 7-76155, for example, provides such a display. The printer having an image memory for storing image data stores the image data of jobs read by a scanner or the image data of jobs transmitted through a communication line in the image memory, and sequentially prints out images corresponding to these jobs. At the time, the printer displays a time period until each of the stored jobs is completed. Thus, the user can make good use of the displayed time period until the desired job is completed.

However, a job stored in the image memory to be printed sometimes cannot be printed by the influence of another job which should be output before the job. In such a case, the displayed estimated time period until the end of the job is temporarily disturbed, in other words, the user can no longer use the estimated time period as accurate information. In the conventional image forming apparatus, such an inaccurate time period continues to be displayed.

SUMMARY OF THE INVENTION

It is therefore an object of the invention to provide an image forming apparatus capable of informing an operator that image formation information will have a prescribed result.

Another object of the invention is, in an image forming apparatus, to inform an operator that an estimated time for the end of a job becomes inaccurate.

Yet another object of the invention is, in an image forming apparatus, to inform an operator that an estimated time for the end of a job becomes inaccurate, and thereafter to inform the operator that the estimated time for the end of the job is accurately displayed.

These objects of the invention are accomplished by providing an image forming apparatus with the following elements. More specifically, the image forming apparatus according to the present invention includes a receiving device receiving a plurality of jobs, an image forming device capable of sequentially forming images of the plurality of jobs, a display device for displaying information related to image formation of the received plurality of jobs, a determination device for determining the state of the image forming apparatus, and a changing device for changing the display of a particular job in the display from a standard display to a particular display.

The state of the image forming apparatus is determined, and the display of information related to image formation of a particular job is changed to the particular display if the result of determination corresponds to a particular case. As a result, the operator can be informed that image formation information will have a prescribed result.

Preferably, the information related to image formation is information related to an estimated time for the end of a job.

The state of the image forming apparatus is determined, and the display of an estimated time for the end of a particular job is changed to the particular display. As a result, the operator can be informed that the time for the end of the particular job is not as estimated.

More preferably, the information related to image formation is information related to an estimated time for the end of a job, and if the result of determination corresponds to a prescribed case, the display of a particular job in the display is changed from the standard display to the particular display, so that the estimated time for the end is corrected and displayed.

If the result of determination corresponds to a prescribed case, information related to the estimated time period for the end is corrected and displayed, and therefore in the image forming apparatus, the operator can be informed if the estimated time for the end of the job is not as estimated, and also thereafter that the time for the end of the job is accurately displayed.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 10A and 10B show displayed images for jobs in a not-normal state when the printer is interrupted.

DESCRIPTION OF THE PREFERRED EMBODIMENTS

Now, a copying machine according to one embodiment of the invention will be described in conjunction with the accompanying drawings.

Figure 1:
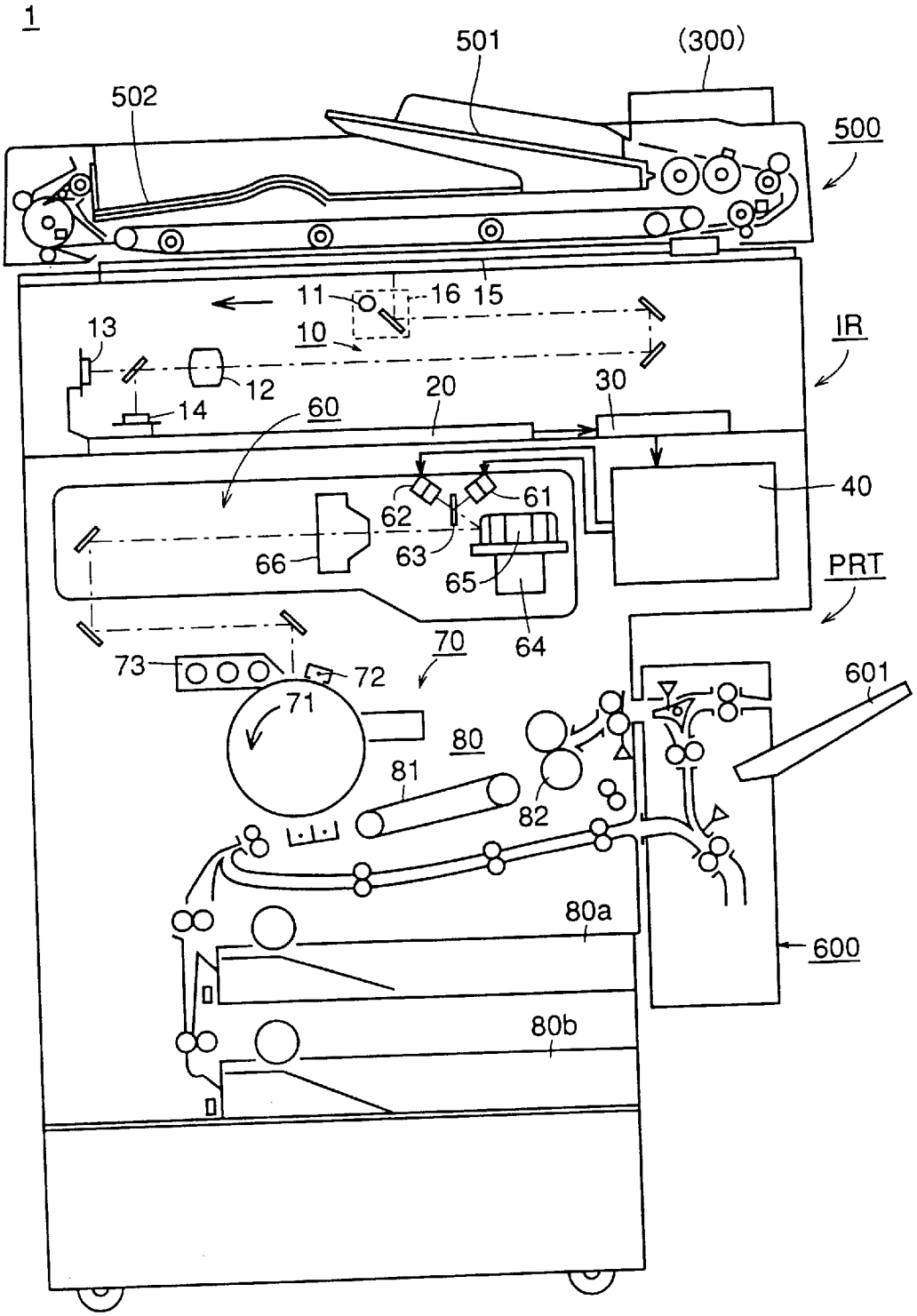
FIG. 1 is a cross sectional view schematically showing the structure of a copying machine according to one embodiment of the invention.

Referring to FIG. 1, a copying machine 1 mainly includes an image reader IR which reads an original image and produces image data, a memory unit for temporarily storing the image data obtained by image reader IR, a printer PRT for printing images on a copying sheet based on the image data stored in memory unit 30, an operation panel 300 provided on the top of copying machine 1 to input operations (in the vertical direction to the surface of the sheet), an original transport unit 500 for transporting an original and reversing the front and back of the original if necessary, and a refeed unit 600 for reversing the front and back of a copying sheet transferred with original images and refeeding the sheet to printer PRC if necessary. These operations are controlled by a control unit (not shown), the structure of which will be described later.

In original transport unit 500, if an instruction is given to print an original set at an original feed tray 501, the original is automatically set on the reading position on an original glass 15 from the lowermost original, and discharged onto a discharge tray 502 once reading by image reader IR is completed.

Image reader IR is formed of a scanning system 10 and an image signal processing unit 20. In scanning system 10, the image of an original sheet set at the reading position is exposed to light from an exposure lamp 11 attached to a scanner 16 traveling under the original. Light reflected from the original passes a reflection mirror and a condensing lens 12, and input to photoelectric conversion elements 13 and 14 formed of a CCD array or the like. Then, a signal obtained at scanning system 10 is sent to image signal processing unit 20. In image signal processing unit 20, the input signal is subjected to image processing such as binarization processing, picture-quality correction, magnification-changing and image editing. The image data after the image processing is stored in memory unit 30.

Printer PRT is formed of a printing processing unit 40, an optical system 60, an image forming system 70, and a paper sheet transport system 80. Printing processing unit 40 drives optical system 60 based on the image data from memory unit 30. In optical system 60, semiconductor lasers 61 and 62 each emit a laser beam based on a signal controlled by printing processing unit 40. These laser beams are combined by a dichroich mirror 64, reflected by a polygon mirror 65 rotated by a motor 64, and directed to a photoreceptor 71 in imaging system 70 through a main lens 66.

In imaging system 70, photoreceptor 71 is charged by a corona charger 72, and then irradiated with a laser beam from optical system 60. Thus, a latent electrostatic image forms on photoreceptor 71. Then, toner is applied on latent electrostatic image by a developer 73. The toner image on photoreceptor 71 is transferred onto a copying sheet fed from a paper feeding cassette 80*a* or 80*b* in paper transport system 80. Then, the paper sheet is transported to a fixing device 82 by the function of paper transport belt 81, the toner is fixed to the sheet by heat and pressure, and then the sheet is discharged onto a discharge tray 601 in paper refeed unit 600.

In copying machine 1, during these operations, errors such as paper jam can be detected by original transport unit 500 and printer PRT. Printer PRT can detect an error such as an empty paper feeding cassette 80*a* or 80*b*, or an error such as an original inappropriately set at the reading position in original transport unit 500. Furthermore, if copying machine 1 stops operating due to a trouble, it can be detected as well. Although not shown, copying machine 1 has a magnetic card reader, and therefore a magnetic card can be used to specify a user if necessary.

Figure 2:
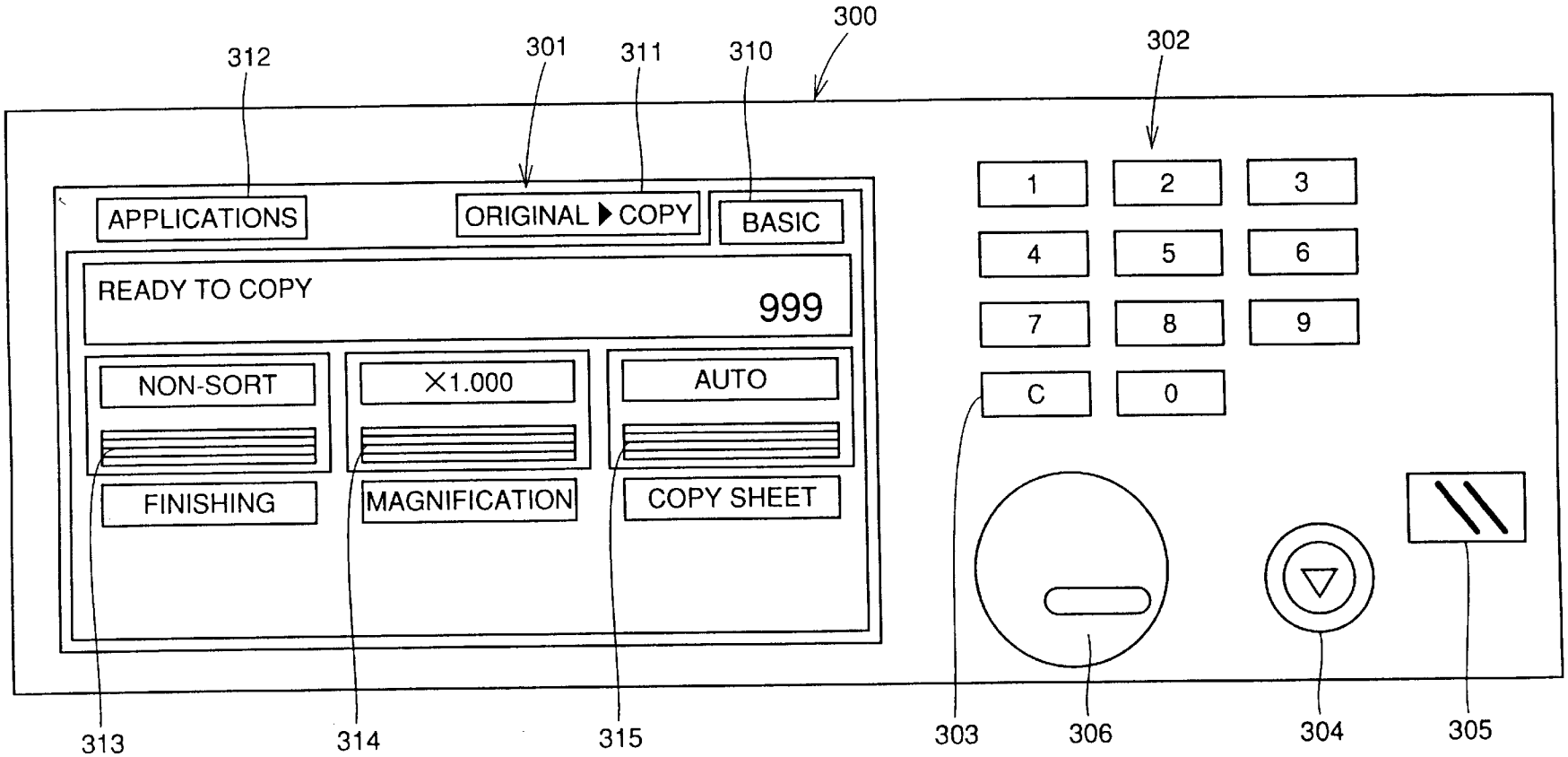
FIG. 2 is a plan view showing the structure of an operation panel.

FIG. 2 is a plan view showing the structure of operation panel 300.

A display portion 301 on operation panel 300 displays a basic image. The basic image is displayed immediately after turning on the power supply or at the time of resetting the panel, and displays touch keys 301, 311 and 312 to select three large items "BASIC", "ORIGINAL→COPY" and "APPLICATIONS", and touch keys 313, 314 and 315 to select further detailed items "FINISHING UP", "MAGNIFICATIONS", and "SHEETS" when "BASIC" is selected.

A ten keys 302 is used to input numerical values such as the number of copies or magnification, and a clear key 303 is used to clear a numerical value input through ten key 302. A start key 306 is used to start copying, and a stop key 304 is used to stop a presently going on copying operation. A panel reset key 305 is used to reset a copying condition set by an operation to a setting image displayed at display portion 301 to the initial condition.

Figure 3:
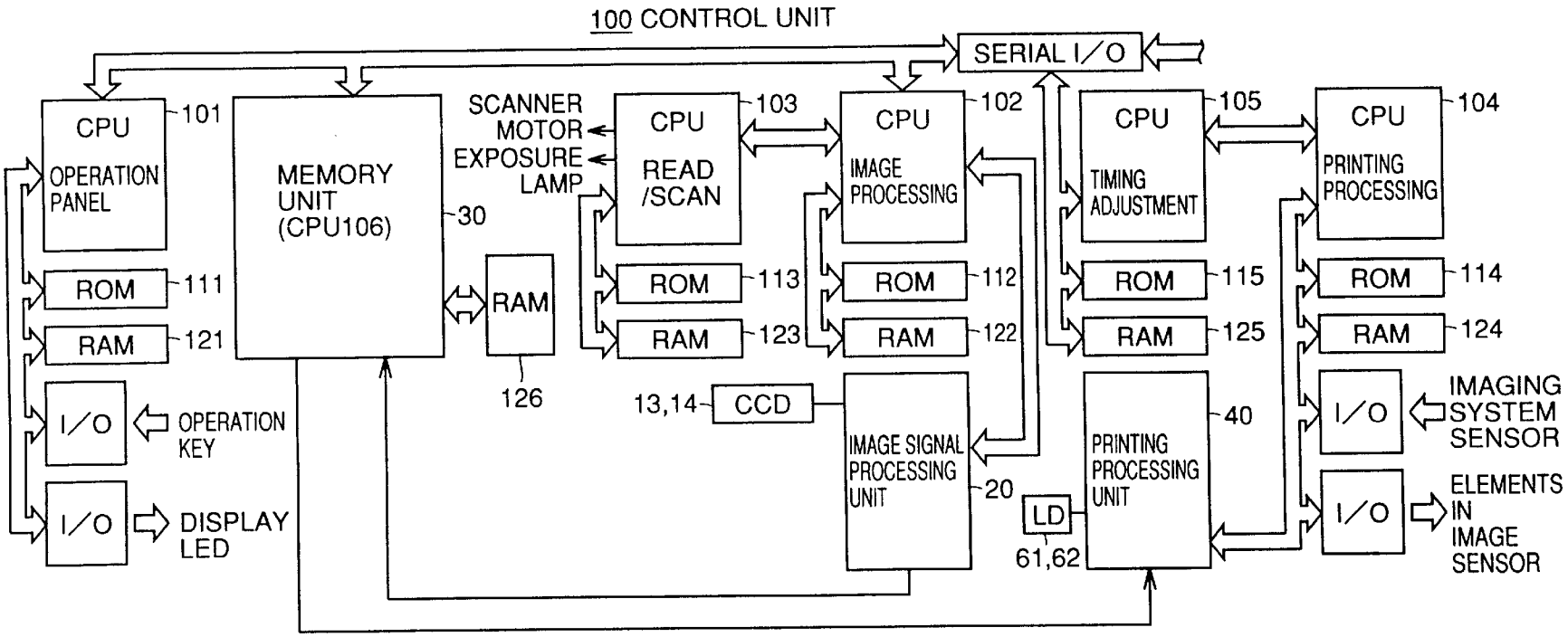
FIG. 3 is a block diagram for use in illustration of the structure of a copying machine control unit.
Figure 4:
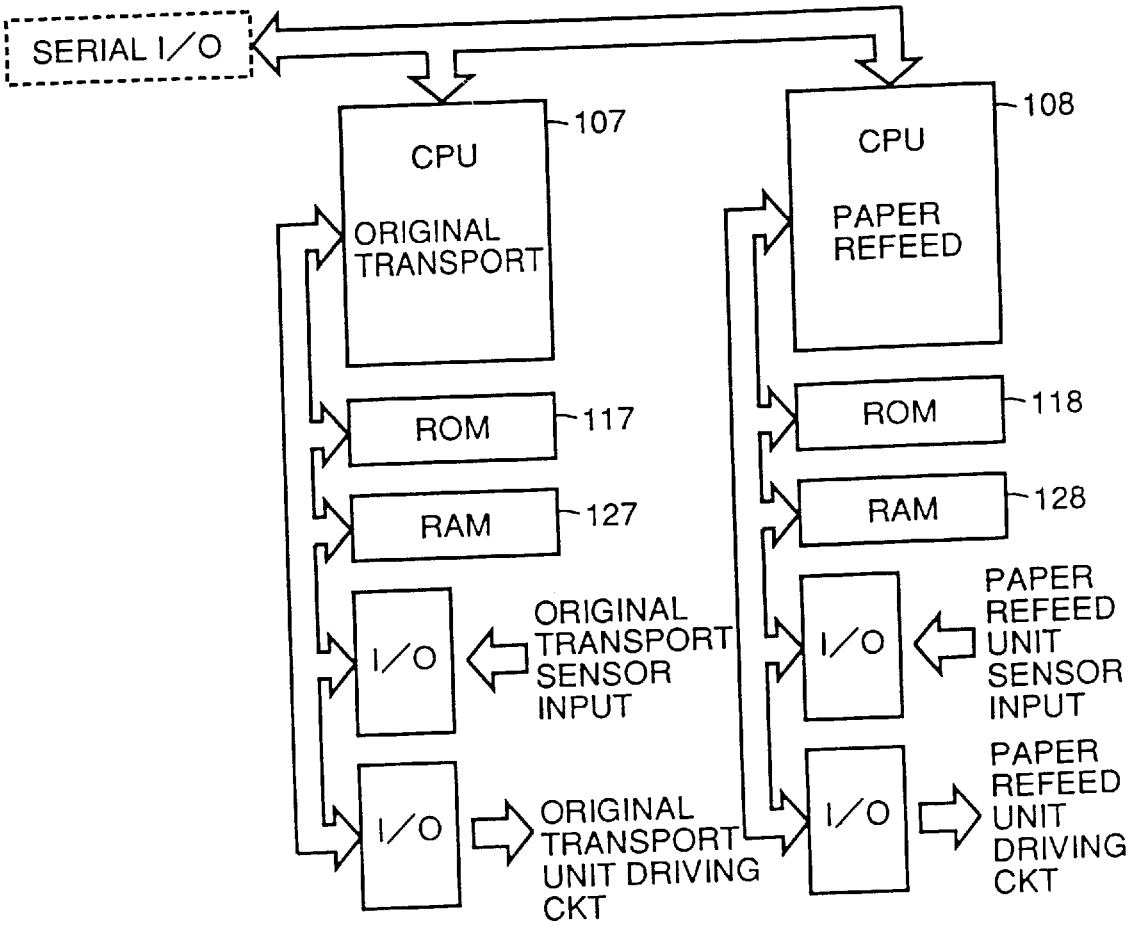
FIG. 4 is a block diagram for use in illustration of the structure of the copying machine control unit.

Now, control unit 100 will be described. FIGS. 3 and 4 are block diagrams for use in illustration of the structure of control unit 100 in copying machine 1.

Control unit 100 is mainly formed of eight CPUs 101 to 108, which respectively have ROMS 111 to 118 storing programs and RAMs 121 to 128 each serving as a work area for executing a program. Note that CPU 106 is provided in memory unit 30.

CPU 101 controls input and display of signals from various operation keys. CPU 102 controls each portion of image signal processing unit 20, and CPU 103 controls driving of scanning system 10. CPU 104 controls printing processing unit 40, optical system 60 and image forming system 70, and CPU 105 performs processing for timing adjustment for the entire control unit 100 and for setting an operation mode.

CPU 106 once stores read image in a memory by controlling memory unit 30, and reads the data for output to printing processing unit 40. Thus, image reader IR and printer PRT are independently controlled for the purpose of improving the copying speed.

CPU 107 controls original transport unit 500, and CPU 108 controls data refeed unit 600. Among CPUs 101 to 108, serial communication is made by interruption and data is exchanged.

Figure 5:
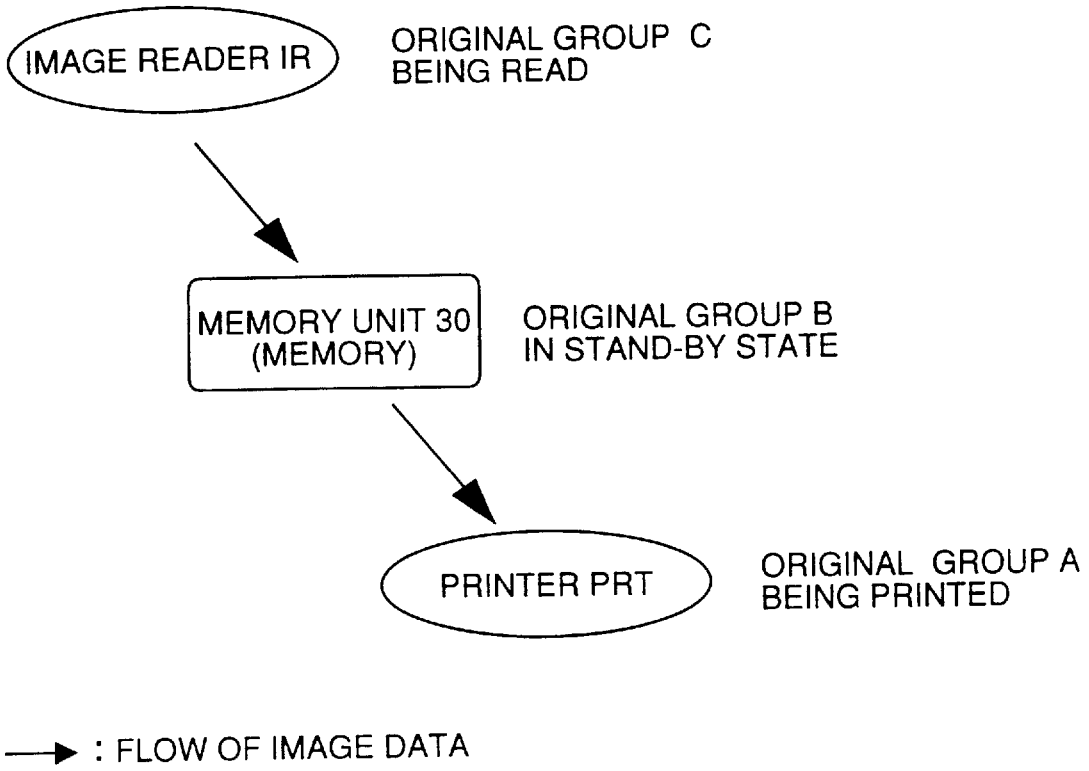
FIG. 5 illustrates a multi-job function in a copying machine.

Copying machine 1 as described above has a multi-job function. FIG. 5 is a diagram for use in illustration of the multi-job function by copying machine 1.

Until copying machine 1 outputs a copy since an original sheet is set, the processing may be roughly divided into three processings, in other words, the processings of reading original images and producing image data, correcting and storing the image data, and printing based on the stored image data. The series of these three processings are performed to a certain group of originals in the above-described order, a copy of the group of originals is obtained. These three processings are performed by image reader IR, memory unit 30, and printer PRT, respectively.

Herein, a multi-job executed by copying machine 1 is to store an original group B in memory unit 30 while outputting a copy of original group A by printer PRT, and at the same time to read an original group C different from these original groups by image reader IR. More specifically, the multi-job function permits the printing operation, the reading operation and the image writing operation to memory unit 30 to be performed independently from each other (hereinafter, the processing by copying machine 1 to each of "original groups" is also called "job".)

Note that since the printing operation and the reading operation are performed independently from each other, when these two operations are being performed at the same time and one of the operations is stopped due to a trouble, the other operation can be continued without interruption.

Now, referring to the flow charts, the procedure of control executed by CPU 101 particularly related to the present invention will be described.

Figure 6:
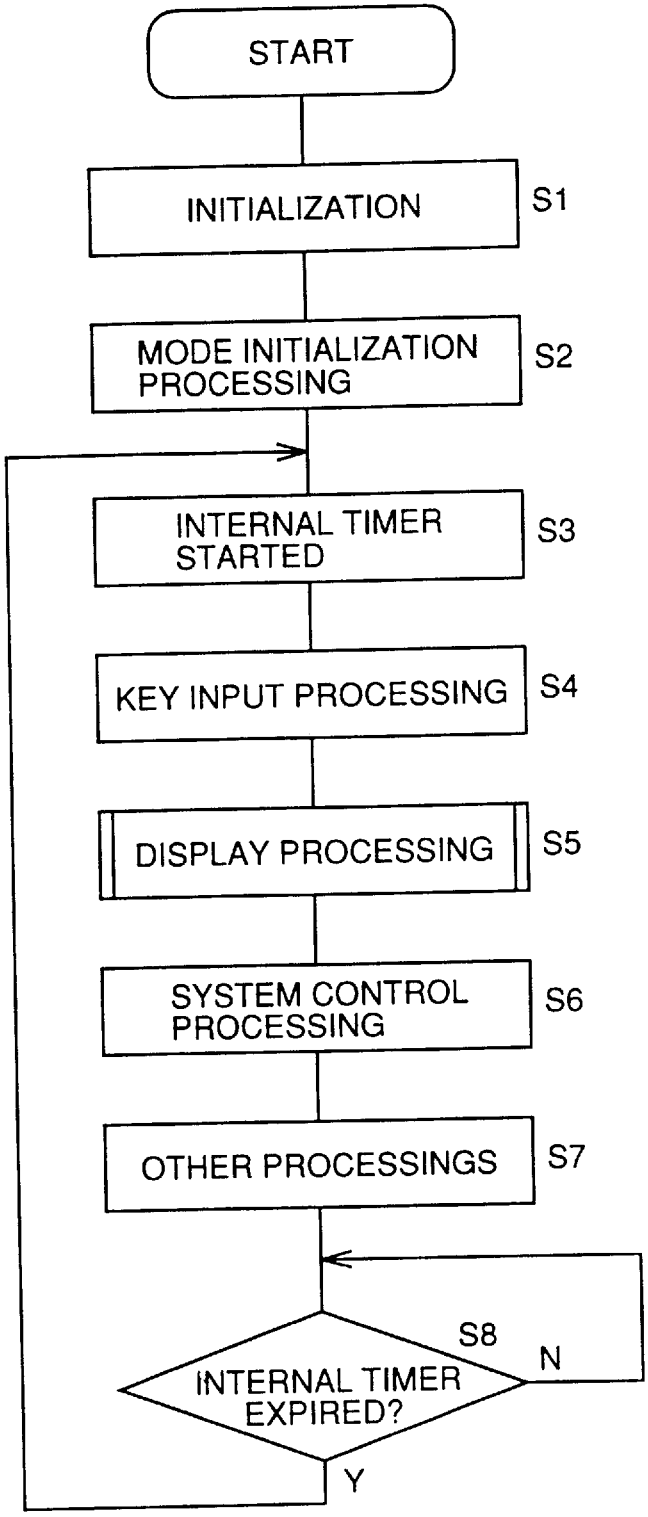
FIG. 6 is a flow chart for use in illustration of a main routine showing a control procedure.

FIG. 6 is a flow chart for use in illustration of a main routine showing the procedure of control executed by CPU 101.

When the power supply of copying machine 1 is turned on and CPU 101 is reset, a program is started. The RAMs are cleared in step 1 (hereinafter "step" is abbreviated as "S"), initialization such as setting various registers is performed to the CPUs, the mode of copying machine 1 is initialized in S2, and the internal timer built in CPU 101 is started in S3. The count value by the internal timer defines the length of one routine, and the value is previously set in the initialization in S1.

Now, key inputs by hard keys and touch keys on operation panel 300 are processed in S4, and corresponding displays to the key inputs are processed in S5. The display processing in S5 includes display of an estimated time for the end of a job related to the present invention, which will be described.

Then, a system control processing to control the normal operation of copying machine 1 is performed in S6, and other processings are sequentially performed in S7. After the processings in S3 to S7, it is determined in step S8 whether the internal timer set in S3 has been expired. If the internal timer is up (YES in S8), one routine is completed, and the processing returns to S3. If the internal timer is not up (NO in S8), the processing remains in S8 and waits for the end of the internal timer.

Figure 7:
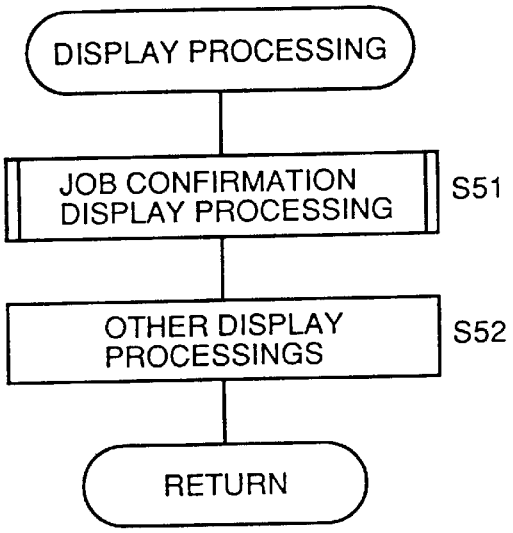
FIG. 7 is a flow chart for use in illustration of a subroutine in a display processing in S5 in FIG. 6.

FIG. 7 is a flow chart for use in illustration of a subroutine in the display processing in S5 in FIG. 6. The subroutine in the display processing in S5 is formed of a job confirmation display processing in S51 and other normal display processings in S52. The job confirmation display processing in S51 is performed in a subroutine, and the job registered in copying machine 1 and its ending time are displayed.

Figure 8:
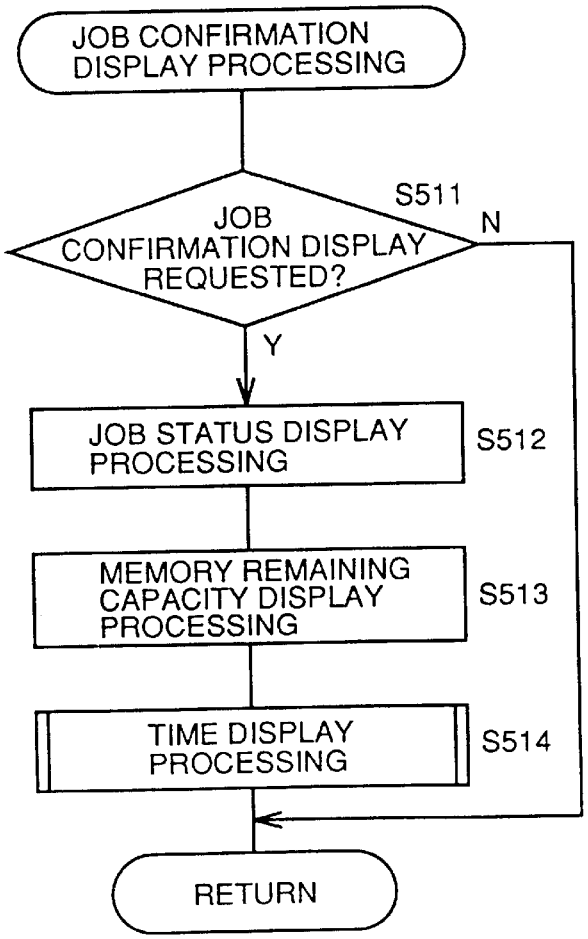
FIG. 8 is a flow chart for use in illustration of a subroutine in a job confirmation display processing in S51 in FIG. 7.

FIG. 8 is a flow chart showing the subroutine in the job confirmation display processing in S51 in FIG. 7.

It is determined in S511 whether the user has pressed a job confirmation key (one of the touch keys displayed on display portion 301 in FIG. 2) to confirm a job registered in copying machine 1. If the job confirmation key has not been pressed (NO in S511), the processings in S512 to 514 as follows are not performed, and the routine directly returns.

If the job confirmation key has been pressed (YES in S511), the state of the registered job is displayed in S512, the remaining capacity for storing by memory unit 30 (FIG. 3) is displayed, estimated time when the registered job is completed is displayed in S514, and the routine returns. Now, a subroutine in the time display processing in S514 will be described.

Figure 9:
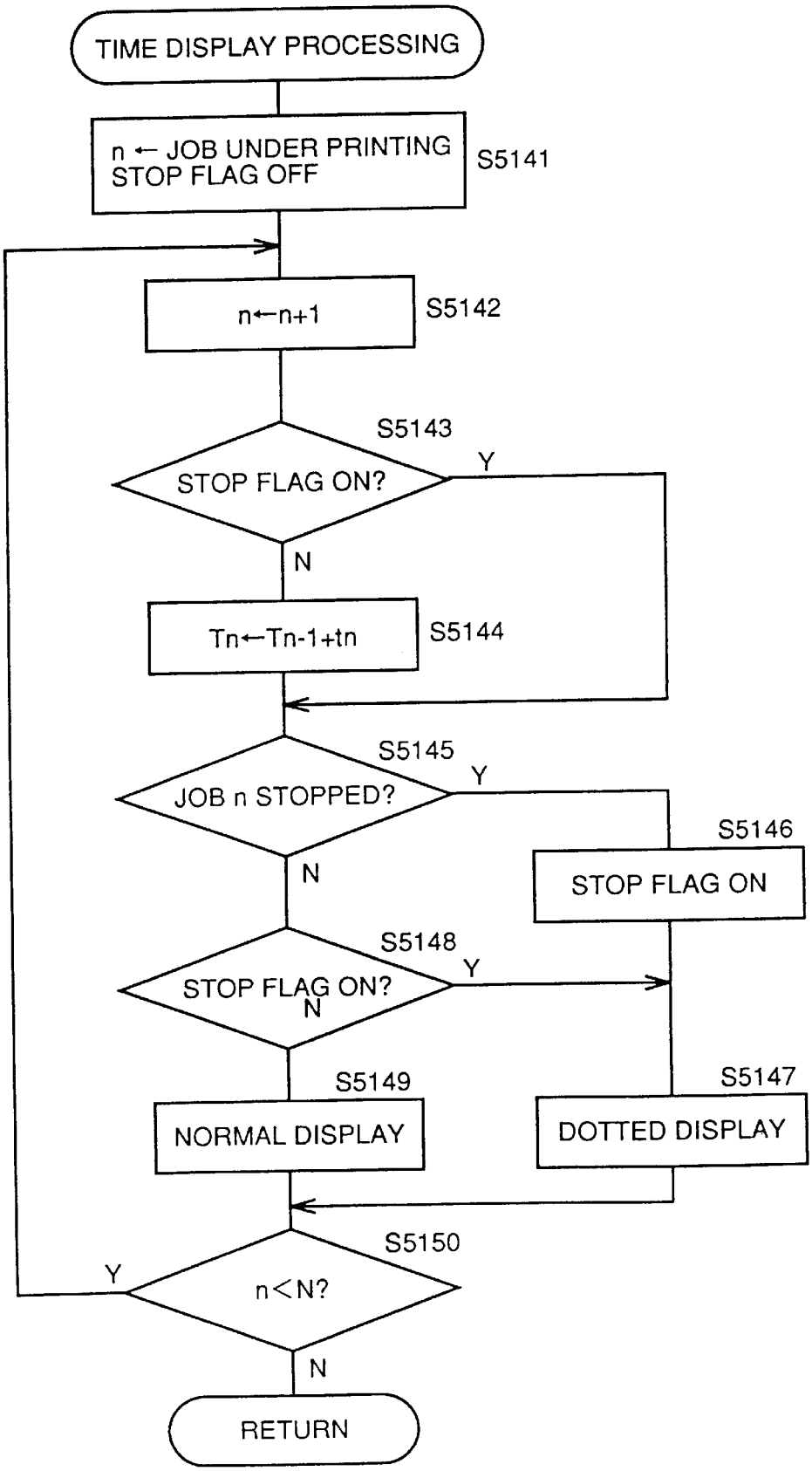
FIG. 9 is a flow chart for use in illustration of a subroutine in a time display processing in S514 in FIG. 8.

FIG. 9 is a flow chart showing the subroutine in the time display processing in S514 in FIG. 8.

A number for a job which copying machine 1 is printing is substituted for n in S514, and a stop flag indicating that printing has been stopped in printer PRT is turned off. 1 is added to n in S5142, and it is determined if the stop flag is turned on (S5143). If the stop flag is turned on (YES in S5143), estimated time Tn for the end of the job is not calculated, the time displayed is not updated, while the calculation in S5144 is made only if the stop flag is off. In S5144, the estimated end time Tn-1 for job n-1 is added with time required for processing job n and the result is substituted for estimated end time Tn for job n, thereby updating the time.

Then, it is determined in S5145 if printing of job n has been interrupted. If the printing of job n has been interrupted (YES in S5145), the stop flag is turned on in S5146, and estimated end time Tn for job n is displayed dotted as shown in FIG. 10, unlike the normal state, and the processing proceeds to S5150.

If the printing of job n has not been interrupted (NO in S5145), it is determined in S5148 if the stop flag is on. If the stop flag is on (YES in S5148), the processing proceeds to S5147, jobs to be processed after the job initially displayed dotted are also displayed dotted. If the stop flag is not on (NO in S5148), estimated end time Tn for job n is normally displayed in S5149, and the processing proceeds to S5150.

It is then determined in S5150 if job number n is smaller than the total number of jobs N registered in copying machine 1. If job number n is smaller than the total number of jobs N (YES in S5150), the processing returns to S5142, while if job number n is not smaller than the total number of jobs N (NO in S5150), the routine returns.

The job in the process of printing and jobs to be printed thereafter when the printing is stopped are displayed dotted lines unlike the normal state by the time display processing routine, and again displayed in the normal state if the stop flag is turned off in response to a restart of printing. An example of display different from the normal state will be described.

FIGS. 10A and 10B show the displays of jobs in a state different from the normal state when printing is interrupted. FIG. 10A shows the display of a job end time in dots, while the job is not displayed in FIG. 10B. These jobs are displayed by pressing the job confirmation key.

FIG. 10A shows that printing is interrupted during printing a job under job number 4, and that time for the end of printing jobs under job numbers 4 and 5 will be probably changed.

As described above, when printing of a certain job is interrupted, the job and the following jobs are displayed in dots, whereby the user can be informed of high probability that the time for the end of printing these jobs may be changed. The user can be also informed of high probability that the time for the end of printing these jobs may be changed if the job and the following jobs are not displayed.

In FIG. 10B, the ending time of the job under job number 4 whose printing has been interrupted and the following job under job number 5 are not displayed in order to indicate that printing has been interrupted during printing the job under job number 4 and the estimated ending time for printing jobs under job numbers 4 and 5 will be probably changed.

A time display processing 2 as follows may be employed in place of the time display processing, the procedure of which is shown in FIG. 9.

Figure 11:
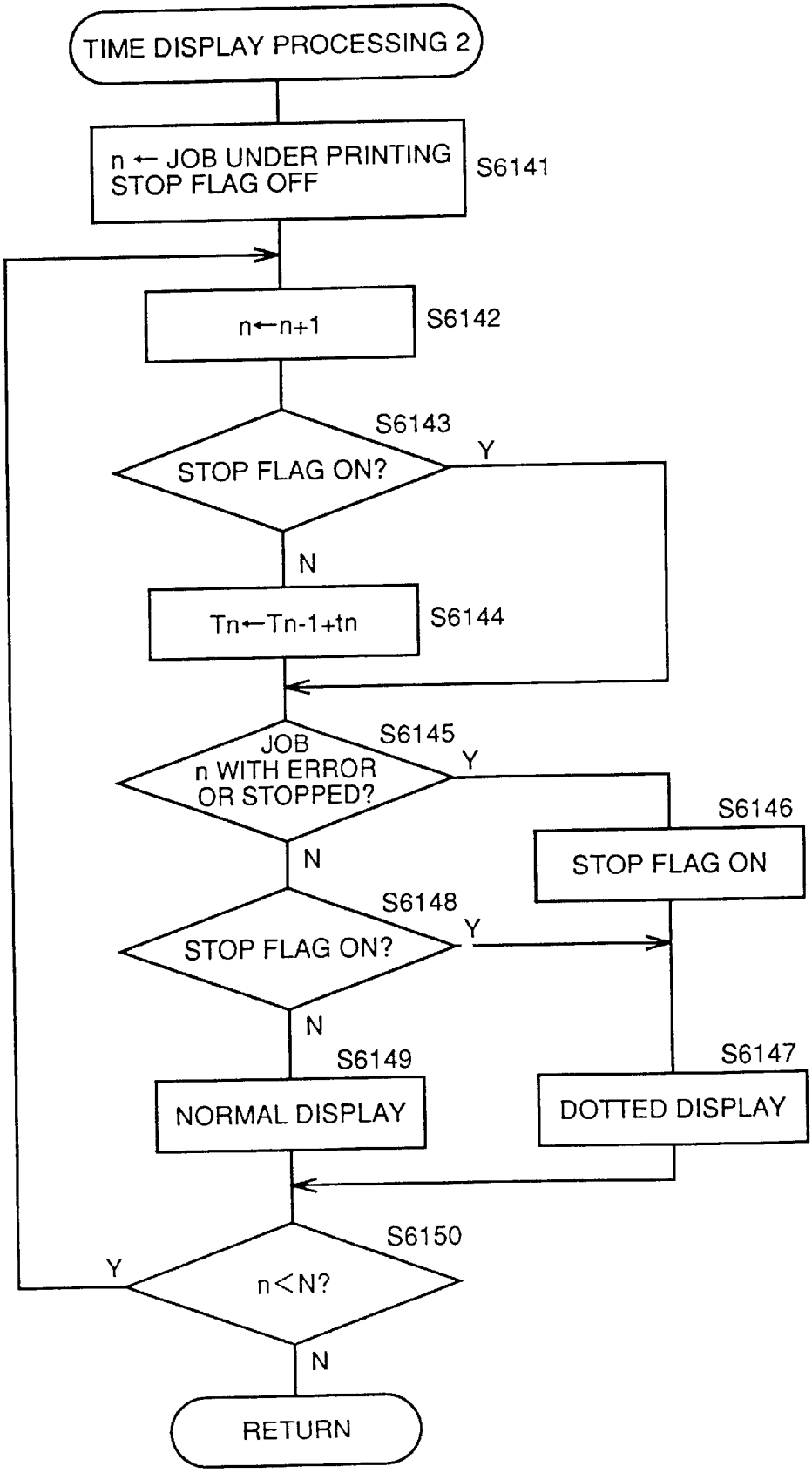
FIG. 11 is a flow chart for use in illustration of a subroutine in a time display processing in place of that shown in FIG. 9.

FIG. 11 is a flow chart showing a subroutine in time display processing 2 in place of FIG. 9. In time display processing 2, the processing in S5145 in the time display processing in FIG. 9 is replaced by the processing in S6145 as follows. The other processings are entirely the same, and will not be described.

While it is determined in S5145 in the time display processing if the printing of job n has been interrupted, it is determined in S6145 in time display processing 2 if the printing of job n has been interrupted or an error has occurred before job n is printed. Therefore, in addition to the case in which the printing job n is interrupted, in the case in which an error has occurred before job n is printed, the stop flag is turned on.

By these time display processing routines, the job in the process when the printing is interrupted or when an error occurs and jobs to be printed thereafter are displayed in dots unlike the normal state, and these jobs are once again normally displayed when the printing is resumed or the error is solved and the stop flag is turned off.

In the copying machine as described above, if it is highly probable that an estimated ending time of a job will be changed, the ending time is displayed in a state different from the normal state, and therefore the user can be surely informed of the probability and can smoothly operate the device.

In the above embodiment, the estimated ending time of a job is displayed, it is understood that a time period until a job is completed may be displayed instead.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a receiving device for receiving a plurality of jobs;

an image forming device capable of sequentially forming images of the plurality of jobs;

a display device displaying information related to image formation of said received plurality of jobs;

a determination device for determining the state of said image forming apparatus; and a changing device for changing the display of a particular job in said display device from a standard to a particular display when the determination by said determination device has a prescribed result.

2. The image forming apparatus as recited in claim 1, wherein said information related to image formation is information related to an estimated ending time for said job.

3. The image forming apparatus as recited in claim 1, wherein said particular display is a flashing display.

4. The image forming apparatus as recited in claim 1, wherein said particular display is to display in blank.

5. The image forming apparatus as recited in claim 1, wherein said changing device changes the display of the particular job in said display device from the standard display to the particular display when the result of determination indicates that the operation of said image forming apparatus related to the job has been stopped.

6. The image forming apparatus as recited in claim 1, wherein said changing device changes the display of the particular job in said display device from the standard display to the particular display when said result of determination indicates that an operation error has occurred in said image forming apparatus.

7. The image forming apparatus as recited in claim 1, wherein when said information related to image formation is information related to an estimated ending time for a job, and said determination has a prescribed result, said changing device changes the display of the particular job in said display device from the standard display to the particular display in order to display information related to an estimated ending time produced by correcting said estimated ending time.

8. An image forming apparatus, comprising:

an image reader for reading a plurality of pieces of data consistent as a group of originals;

a storage device for storing said image data;

an image forming device for forming images based on said image data;

a display device for displaying information related to time when said image formation is completed;

a determination device for determining the state of said image forming device; and a changing device for changing the display of the ending time of the image formation in said display device from a standard display to a particular display when the determination by said determination device has a prescribed result.

9. The image forming apparatus as recited in claim 8, wherein said changing device changes the display in said display device from the standard display to the particular display when the determination indicates that the operation of said image forming device has been stopped.

10. The image forming apparatus as recited in claim 8, wherein said changing device changes the display of a particular job in said display device from the standard display to the particular display when said determination result indicates that an operation error has occurred in said image forming apparatus.

11. The image forming apparatus as recited in claim 8, wherein said changing device changes the display of a particular job in said display device from the standard display to the particular display in order to display information related to an estimated ending time produced by correcting said estimated ending time, when said determination has a prescribed results.

* * * * *

UNITED STATES PATENT AND TRADEMARK OFFICE

CERTIFICATE OF CORRECTION

PATENT NO. : 5,809,371

DATED : September 15, 1998

INVENTOR(S) : Kazuo Inui, et al.

It is certified that error appears in the above-identified patent and that said Letters Patent is hereby corrected as shown below:

Column 1, line 14, change "machine and printer" to --machines and printers--.

Column 1, line 14, change "has" to --have--.

Column 1, line 14, delete "an".

Column 1, line 14, change "apparatus" to --apparatuses--.

Column 1, line 52, delete "becomes" and insert --has become--.

Column 1, line 55, delete "becomes" and insert --has become--.

Column 2, line 57, delete "show" and insert --are schematic views showing--.

UNITED STATES PATENT AND TRADEMARK OFFICE

CERTIFICATE OF CORRECTION

PATENT NO. : 5,809,371

DATED : September 15, 1998

INVENTOR(S) : Kazuo Inui, et al.

It is certified that error appears in the above-identified patent and that said Letters Patent is hereby corrected as shown below:

Column 3, line 43, change "dichroich" to --dichroic--.

Column 4, line 12, change "keys" to --key--.

Column 5, line 33, delete "been".

Signed and Sealed this

Ninth Day of March, 1999

*Attest:*

*Attesting Officer*

Q. TODD DICKINSON

*Acting Commissioner of Patents and Trademarks*